US006959807B2

(12) United States Patent
Sharon et al.

(10) Patent No.: US 6,959,807 B2
(45) Date of Patent: Nov. 1, 2005

(54) MULTI-COMPARTMENT CONTAINER ASSEMBLY SYSTEM

(75) Inventors: Igal Sharon, Caesaria (IL); Yohanan Maggeni, Lower Galilee (IL)

(73) Assignee: M.L.I.S. Projects Ltd.

( * ) Notice: Subject to any disclaimer, the term of this patent is extended or adjusted under 35 U.S.C. 154(b) by 149 days.

(21) Appl. No.: 10/294,020

(22) Filed: Nov. 12, 2002

(65) Prior Publication Data

US 2004/0089563 A1 May 13, 2004

(51) Int. Cl.[7] ..... B65D 25/08; B65D 71/00
(52) U.S. Cl. ..... 206/219; 206/221; 206/568
(58) Field of Search ..... 206/219, 220, 206/221, 568; 215/DIG. 8; 222/129, 130

(56) References Cited

U.S. PATENT DOCUMENTS 4,823,946 A * 4/1989 Stoeffler et al. ..... 206/221
5,000,314 A * 3/1991 Fuller et al. ..... 206/221
5,277,303 A * 1/1994 Goyet et al. ..... 206/221
5,348,060 A * 9/1994 Futagawa et al. ..... 141/100
5,564,600 A * 10/1996 Renault ..... 222/129
5,638,968 A * 6/1997 Baron et al. ..... 215/11.4
5,692,644 A * 12/1997 Gueret ..... 222/80
5,875,888 A * 3/1999 Albisetti ..... 206/221
5,875,889 A * 3/1999 Albisetti ..... 206/221
6,021,892 A * 2/2000 Baudin ..... 206/221
6,481,571 B1 * 11/2002 Kelders et al. ..... 206/219
6,543,645 B2 * 4/2003 Lacout ..... 222/129
2003/0024830 A1 * 2/2003 Sharon ..... 206/219

* cited by examiner

*Primary Examiner*—Derris H. Banks
*Assistant Examiner*—Faye Francis
(74) *Attorney, Agent, or Firm*—Mark M. Friedman

(57) ABSTRACT

A container assembly system for storing multiple components of a formulation in separate individually sealed assembly units or containers that can be assembled into a single multi-compartment container. The components of a formulation may be stored in each of the individually sealed assembly units while the assembly units remain sealed and then assembled into a multi-compartment container. The seals sealing each of the assembly units can then be unsealed so that the components can be mixed into a formulation.

6 Claims, 11 Drawing Sheets

MULTI-COMPARTMENT CONTAINER ASSEMBLY SYSTEM

FIELD OF THE INVENTION

This invention relates to a multi-compartment container system and assembly for separately storing two or more components in individual containers until ready for combining and mixing prior to use. This invention further relates to a multi-compartment container that may be used to dispense a predetermined amount of the content of the multi-compartment container.

BACKGROUND OF THE INVENTION

A multi-compartment container assemblies are known in the art where two or more individually sealable assembly units may be joined together to assemble a multi-compartment container. One concern with such multi-compartment container assemblies is that at least one of the assembly units must be unsealed before other sealed assembly units can be attached to it to form a multi-compartment container. Removing the seals during the assembly process introduce a potential risk of contaminating or spilling the contents of the assembly units.

SUMMARY OF THE INVENTION

The present invention provides a multi-compartment container system and assembly in which two or more individually sealable container assembly units can be assembled into a multi-compartment container while each of the assembly units remain sealed. One advantage of the multi-compartment assembly is that the sealed assembly units, can be assembled into a multi-compartment assembly while each of the assembly units remain sealed. Because the multi-compartment assembly can be assembled without unsealing the assembly units, any risk of contaminating the contents of each of the assembly units is minimized. The seals between the assembly units can subsequently be unsealed while in their assembled state so that the contents of the assembly units can be mixed into a formulation and then dispensed from the assembly.

In a preferred embodiment of the invention, two assembly units are assembled together to form a two-compartment container, each of the assembly units forming a sealed compartment. Each of the assembly units have at least one sealed opening that engage one another to assemble the units into a two-compartment container. In this assembled state, sealing mechanisms sealing the at least one sealed opening of the assembly units may be adapted and configured to couple with one another. The coupling may be effectuated during the assembly of the container or subsequently at a later desired time. This coupling configuration allow the sealing mechanisms of the two assembly units to unseal simultaneously when either one of the sealing mechanisms is axially displaced into an unsealed position. This establishes a flow-communication between the two assembly units allowing the contents of the two assembly units to be mixed.

In another embodiment of the invention, the multi-compartment container system may be configured and adapted so that one of the compartments at the terminal ends of the assembly is measured to hold a predetermined amount of substance to be dispensed.

The way in which the sealing mechanisms of each of the two assembly units couple will now be illustrated in some specific embodiments but it will be appreciated by one of ordinary skill in the art that the same principle is also applicable to form containers with additional separate compartments. For example, in applications where more than two assembly units are assembled together to form a multi-compartment container having more than two compartments, the sealing mechanisms involved between any two assembly units may couple so that they may be unsealed simultaneously.

The drawings are only schematic and are not necessarily to scale.

DETAILED DESCRIPTION OF THE INVENTION

Some examples of the multi-compartment containers are provided to illustrate various specific configurations and examples of the invention. The invention should not be regarded as being limited to these embodiments. The containers may also be used for different uses, e.g., two or more compartment containers for medicinal formulations, dietary powders to be reconstituted with a liquid, alcoholic beverages to form cocktails with other ingredients or various non-alcoholic beverages that are prepared from powders wherein one compartment contains one component and the other compartment contains another component to be mixed to form a formulation. The multi-compartment containers may also be used to store a quantity of a substance to be dispensed in a predetermined desired quantities. For example, in a two-compartment container embodiment, one compartment may hold a supply of medication and the second compartment may be configured and sized for a predetermined single dosage of that medication. To minister the dosage, the seals partitioning the two compartments are unsealed establishing a communication passage between the compartments and allow the medication to fill the second compartment. Once the second compartment is filled, the compartments may be partitioned again by closing the seals and the measured contents of the second compartment may be dispensed.

Figure 1:
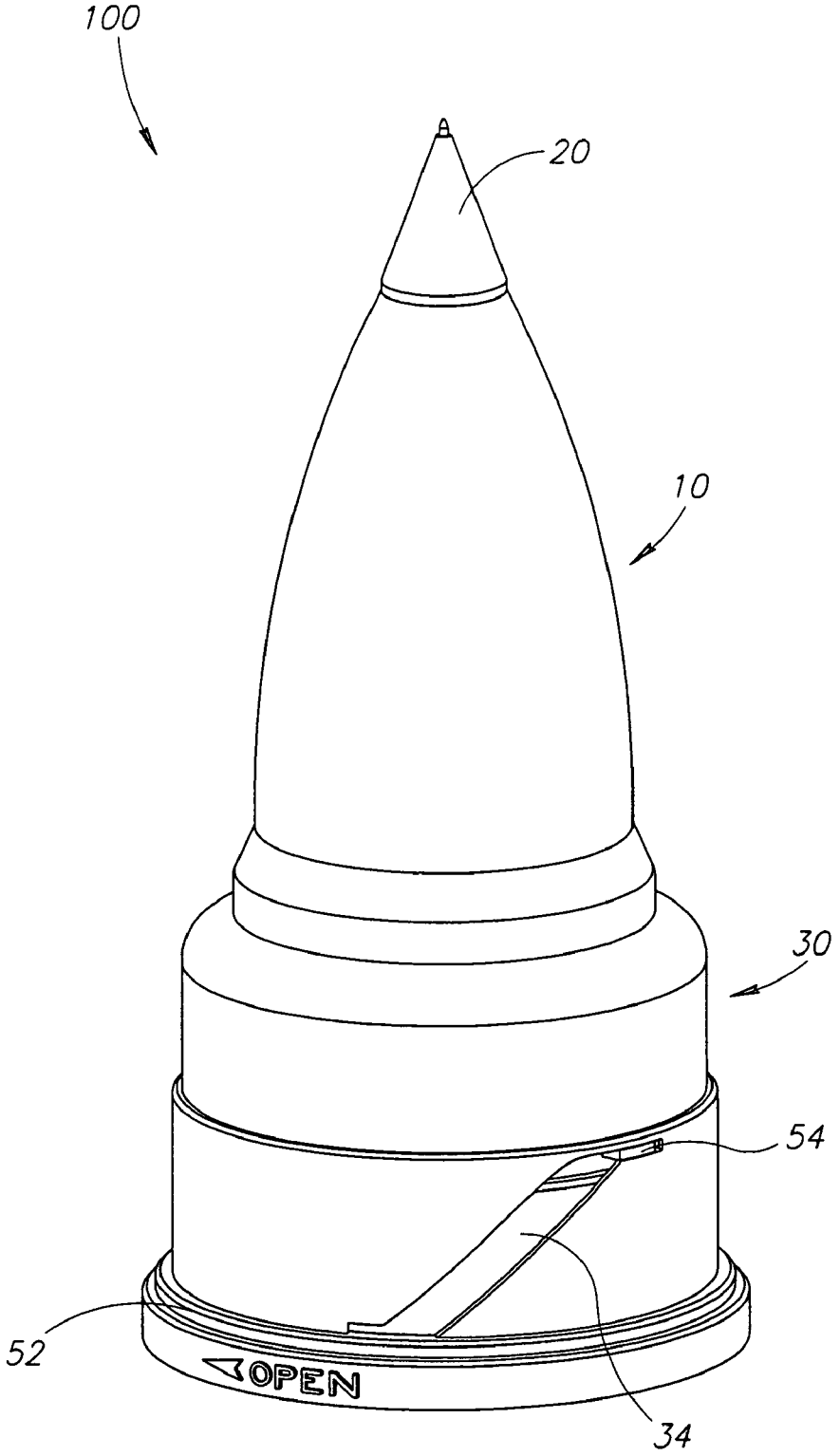
FIG. 1 is a perspective view of a two-compartment container assembly according to an embodiment of the invention.
Figure 2:
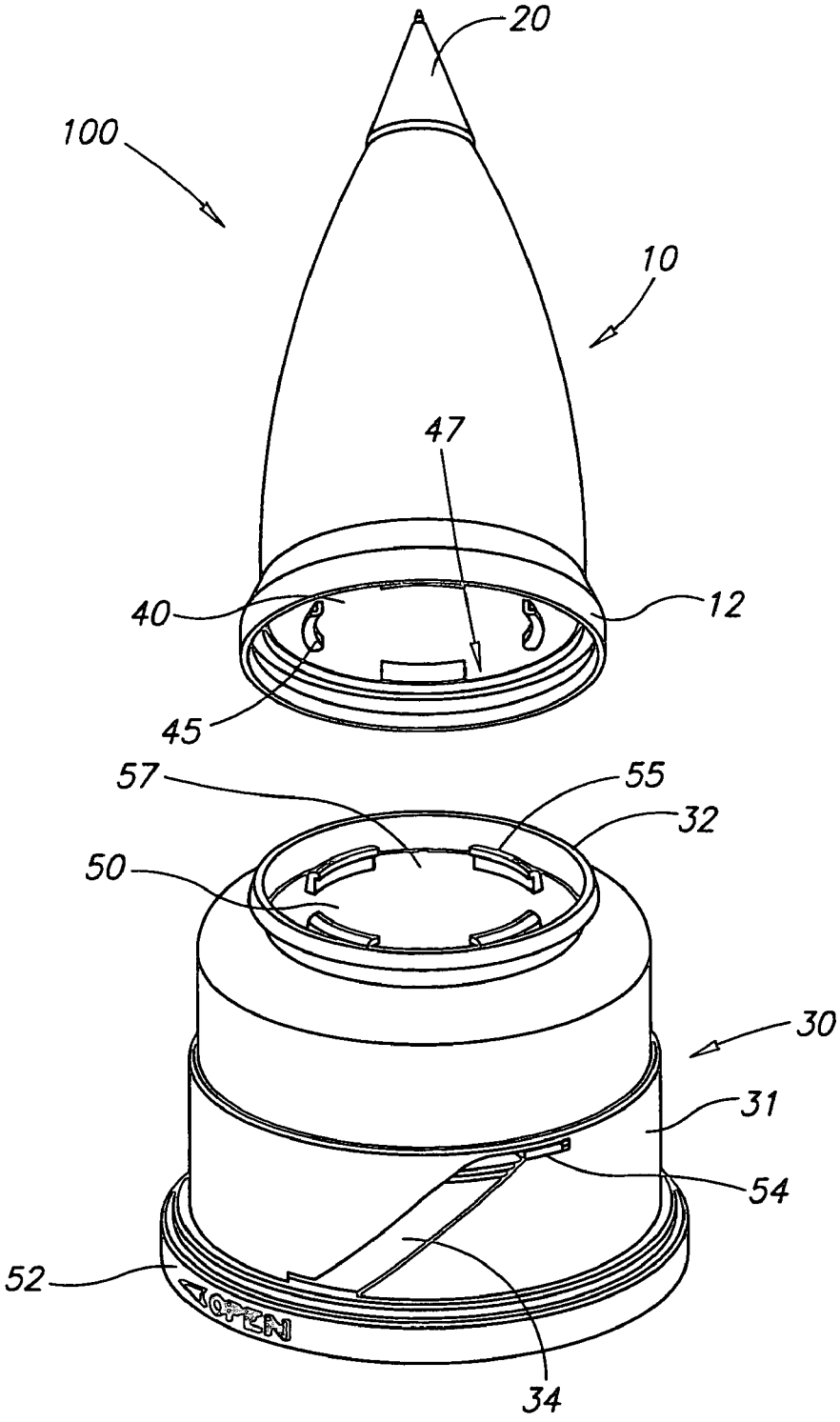
FIG. 2 is a perspective view of the two-compartment container assembly of FIG. 1 with the dispensing unit and the cartridge unit separated.

FIG. 1 illustrates a preferred embodiment of a two-compartment container assembly 100. The two-compartment container 100 is assembled from two assembly units: a dispensing unit 10 and a cartridge unit 30. Each of these assembly units are individually sealable containers that may be filled with a component that may be sealed and stored in them. The FIG. 2 illustrates the dispensing unit 10 and the cartridge unit 30 detached from one another as discrete assembly units. Both of these assembly units 10, 30 may be containers having sealable openings at top and bottom ends. A flange 12 provided at the bottom end of the dispensing unit 10 engages a rim 32 provided at the top end of the cartridge unit 30 when the dispensing unit 10 and the cartridge unit 30 are assembled into a two-compartment container 100. The diameters of the flange 12 and the rim 32 are such that they preferably engage to form a seal. The quality of the seal should be sufficiently tight for a given application for the container 100. In a preferred embodiment, however, the seal should be of such quality to keep the contents of the container from leaking and keep any undesirable substances from entering the assembled container and possibly contaminating or compromising the quality of the contents of the container 100.

In this illustrated example, the flange 12 has a larger diameter than the rim 32 and it fits over the rim 32. But, the dispensing unit 10 and the cartridge unit 30 may be configured with many other variety of structures to sealingly engage one another to form a seal. The mating surfaces of the flange 12 and the rim 32 may be provided with raised sealing ridges that produce friction-fitted seal at the mating interface. Alternatively, at least one of the mating surfaces may be provided with elastomeric seals to form compression seal at the mating interface.

The bottom end of the dispensing unit 10 is sealed with a sealing member 40 and the top end of the cartridge unit 30 is sealed with a top sealing wall 50. According to one embodiment of the present invention, the sealing member 40 and the top sealing wall 50 are configured and adapted to couple with one another when the top sealing wall 50 is axially displaced downwardly. So, as the top opening of the cartridge unit 30 is unsealed, the sealing member 40 is also pulled downwardly along with the top sealing wall 50, thereby unsealing the bottom end opening of the dispensing unit 10. The specific manners by which the two sealing mechanisms (the sealing member 40 and the top sealing wall 50) couple may be achieved in a number of different ways within the scope of the present invention.

For example, in the embodiment illustrated in FIG. 2, the sealing member 40 is provided with two or more coupling arms 45 on its bottom surface, i.e., the surface facing the cartridge unit 30 when the dispensing unit 10 and the cartridge unit 30 are being assembled together. The top sealing wall 50 of the cartridge unit 30 is provided with its own set of two or more coupling arms 55 that correspond to the coupling arms 45. The coupling arms 45, 55 are arranged radially with spaces 45A, 55A between the coupling arms 45 and 55, respectively. When the dispensing unit 10 and the cartridge unit 30 are brought together and assembled, the coupling arms 45, 55 align with the spaces 55A, 45A, respectively so that the coupling arms 45, 55 do not interfere with one another.

Figure 3:
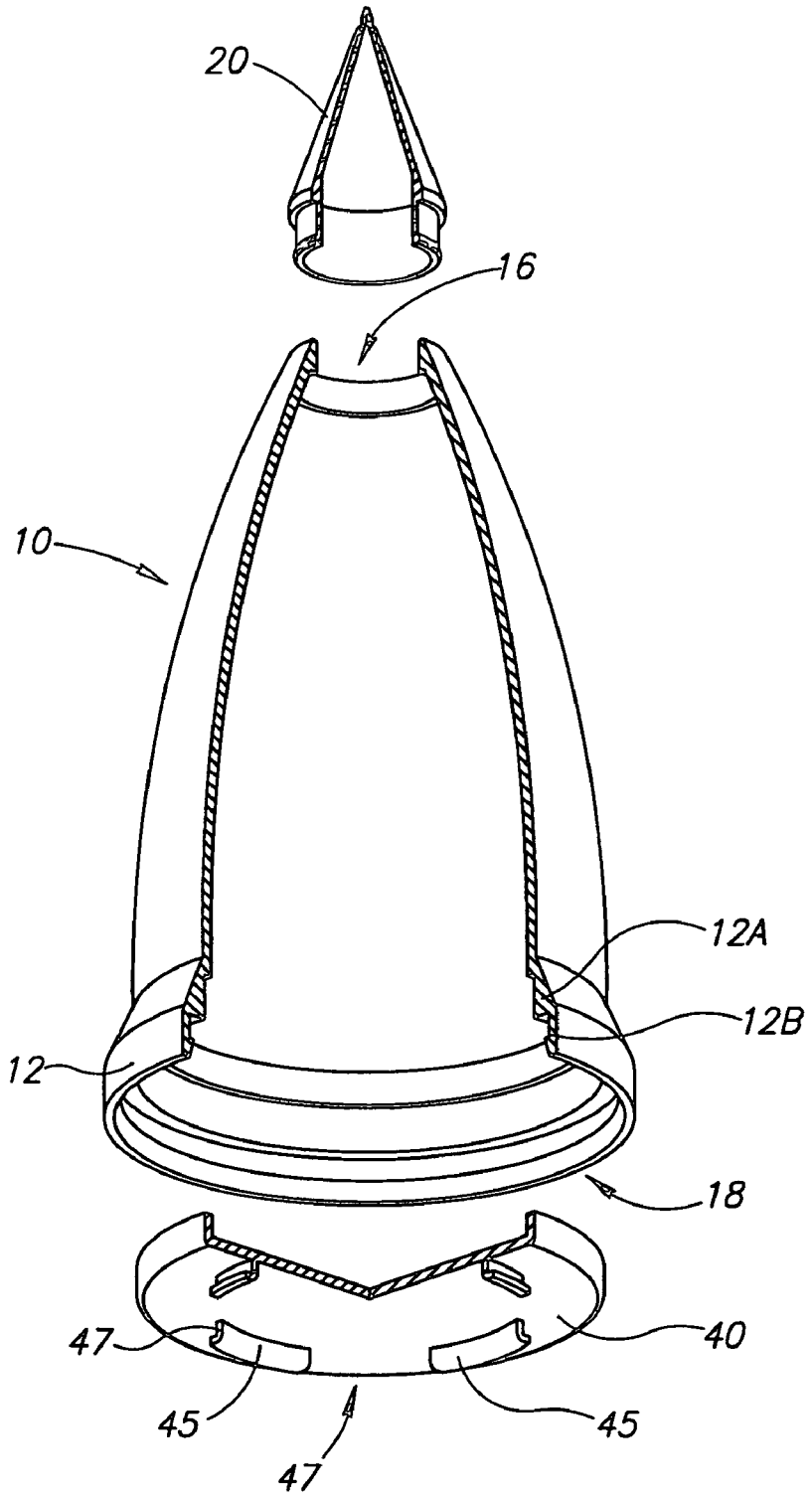
FIG. 3 is an exploded partial cutaway view of the dispensing unit of FIG. 1.

FIG. 3 illustrates a detailed partial cutaway view of the dispensing unit 10 and the coupling arms 45 can be seen in more detail. The coupling arms 45 have a J-shaped profile and protrude from the sealing member 40 with the top of the J-shaped coupling arms 45 being attached to the sealing member 40 with the bottom of the J-shaped coupling arms 45 forming locking ridges 47. The dispensing unit 10 has two openings: a top opening 16 and a bottom opening 18. The top opening 16 may be sealed with a top sealing member 20. The bottom opening 18 is defined by a flange 12. The flange 12 may comprise an upper flange portion 12A and a lower flange portion 12B. A bottom sealing member 40 engages the upper flange portion 12A to seal the bottom opening 18 of the dispensing unit 10. Preferably, the bottom sealing member 40 and the upper flange portion 12A are configured to engage and form a seal. The bottom sealing member 40 may be a friction-fitting plug, a snap-fitting plug, or other sealing methods and mechanisms that will provide a seal with the necessary sealing quality. Of course the quality of the seal formed by the bottom sealing member 40 or any of the other seals in the container system will depend upon the particular application, but in a preferred embodiment of the present invention, the seals should at minimum keep the contents of the assembly units from leaking and keep any undesired substances from entering the assembly units and possibly contaminating or compromising the quality of the contents of the assembly units.

The seal formed at the top opening 16 by the top sealing member 20 is preferably of such quality that the dispensing unit may be filled with either liquid or solid substances and also protect the contents of the dispensing unit from contamination during storage. The top sealing member 20 may be a screw cap, a friction-fitting plug, a snap-fitting plug, a heat-sealed membrane, or sealing methods or mechanisms.

Figure 4:
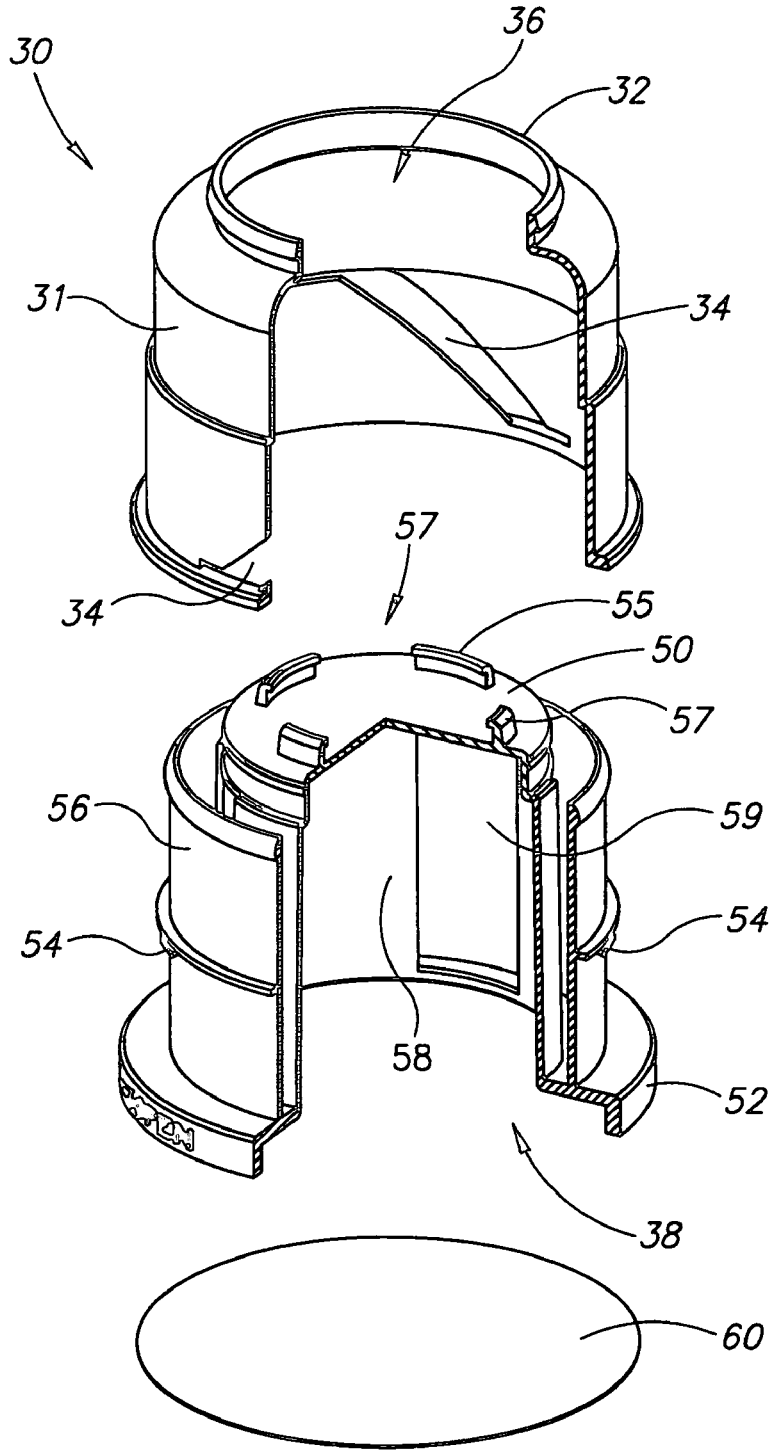
FIG. 4 is an exploded partial cutaway view of a cartridge unit of FIG. 1.

FIG. 4 illustrates an exploded partial cutaway view of the cartridge unit 30 which may be engaged with the dispensing unit 10 to form a two-compartment container. A multi-compartment container system and assembly utilizing a cartridge unit such as the cartridge unit 30 is disclosed in detail in pending U.S. patent application Ser. No. 10/214,374, filed Aug. 6, 2002, and the disclosure of which is incorporated herein by reference.

Cartridge unit 30 comprises a cartridge housing 31 with a top opening 36 defined by a rim 32 and a displaceable member 56 provided within the cartridge housing 31. The displaceable member 56 is axially displaceable within the cartridge unit's housing 31 between a sealed position and an unsealed position. In its sealed position, the displaceable member's top sealing wall 50 engages the rim 32 and seals the top opening 36. In its unsealed position, the displaceable member 56 is axially displaced away from the rim 32 leaving the top opening 36 open. The bottom opening 38 of the cartridge unit 30 is defined by the bottom end of the displaceable unit 56 and it provides access to the internal space of the cartridge unit 30 so that the cartridge unit 30 may be filled with its contents. The bottom opening 38 may be sealed with any appropriate closure member 60. The closure member 60 may be a screw cap, a friction fitting plug, a snap-fitting plug, a heat-sealed membrane, or other sealing methods and mechanisms.

When the cartridge unit 30 and the dispensing unit 10 are assembled, a rim 32 is inserted into a flange portion 12 of the dispensing unit 10. The rim 32 and the flange portion 12 are configured and adapted to form a seal that is of appropriate quality for a given application. The mating surfaces of the rim 32 and the flange portion 12 may be provided with sealing ridges or other similar type of structures to produce a friction-fitting seal at the mating interface. For example, the mating surfaces may be configured with an elastomeric material to form the seal. Alternatively, the rim 32 and the flange portion 12 may be provided with screw threads so that the dispensing unit 10 and the cartridge unit 30 may be screwed together for assembly.

The displaceable member 56 has a user manipulable portion 52 for axially displacing the displaceable member 56 between the sealed position and the unsealed position. To guide the axial motion of the displaceable member 56, the displaceable member 56 may be provided with one or more guide pins 54 and the cartridge housing 31 is provided with a corresponding number of guide slots 34 within which the guide pins are situated. The number of guide slots 34 and the guide pins 54 need not be equal. For example, more guide slots 34 than guide pins 54 may be provided. As illustrated in FIGS. 1–4, the guide slots 34 are S-shaped with the terminal ends forming horizontal sections. By twisting the manipulable portion 52 about the longitudinal axis of the cartridge unit 30 in the direction indicated by arrow A on the manipulable portion 52 in FIGS. 1 and 2, the guide pins 54 will follow the path of the guide slots 34 and the displaceable member 56 will move accordingly. Thus, the displaceable member 56 will first just rotate about its longitudinal axis without any axial translation, then the displaceable member 56 will move in at least an axial direction (i.e., along the longitudinal axis of the cartridge unit 30).

During the initial movement of the displaceable member 56 without any axial translation, the coupling arms 45, 55 are brought into interlocking positions. Then during the axial movement of the displaceable member 56, the top sealing wall 50 and the coupled sealing member 40 will both simultaneously unseal. The displaceable member 56 is connected to the sealing wall 50 via one or more connecting member 58. And, in between the connecting members 58 are spaces 59 that allow the internal space of the cartridge unit 30 (defined by the displaceable unit 56) to communicate with the external environment through the top opening 36 when the displaceable unit 56 is in the unsealed position.

In FIG. 4, the coupling arms 55 provided on the top sealing wall 50 of a displaceable member 56 can be seen in more detail. Similar to the coupling arms 45, the coupling arms 55 also have a J-shaped profile and they protrude from the top surface of the top sealing wall 50. The top of the J-shaped coupling arms 55 are attached to the sealing wall 50 with the bottom of the J-shaped coupling arms 55 forming locking ridges 57. After the dispensing unit 10 and the cartridge unit 30 are assembled together as illustrated in FIG. 1, as the displaceable member 56 is rotated by turning the manipulable portion 52 in the direction of arrow A, the coupling arms 45 and 55 align with one another so that the locking ridges 47 and 57 interlock. As can be seen in FIGS. 3 and 4, the coupling arms 45 are oriented with their locking ridges 47 facing radially outward while the coupling arms 55 are oriented with their locking ridges 57 facing radially inward so that they interfere and interlock with one another. Of course, the orientation of both locking ridges 47, 57 may be reversed.

Figure 5:
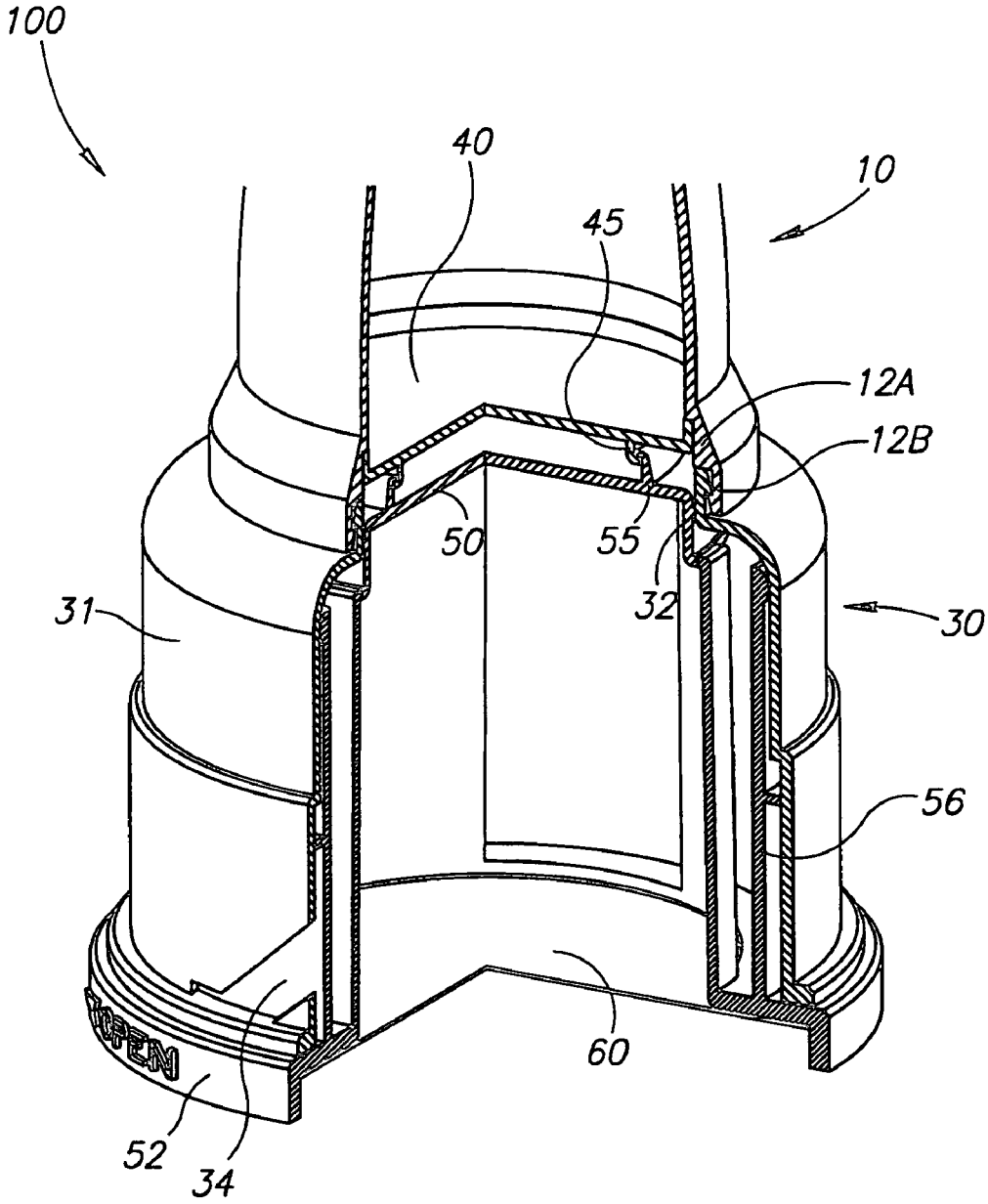
FIG. 5 is a detailed partial cutaway view of the two-compartment container assembly of FIG. 1 with the displaceable member in its sealed position.

FIG. 5 illustrates a detailed cutaway view of a fully assembled two-compartment container 100 whose assembly units are in sealed state. The lower flange portion 12B of the dispensing unit 10 and the rim 32 of the cartridge 30 are sealingly engaged. The bottom sealing member 40 is sealingly engaged to the upper flange portion 12A of the dispensing unit 10, sealing the bottom opening of the dispensing unit 10. The displaceable member 56 is in its sealed position so that the top sealing wall 50 has sealingly engaged the top opening of the cartridge unit 30 and the coupling arms 45 and 55 are in an unlocked position. The bottom opening of the cartridge unit 30 is sealed with the closure member 60.

Figure 6:
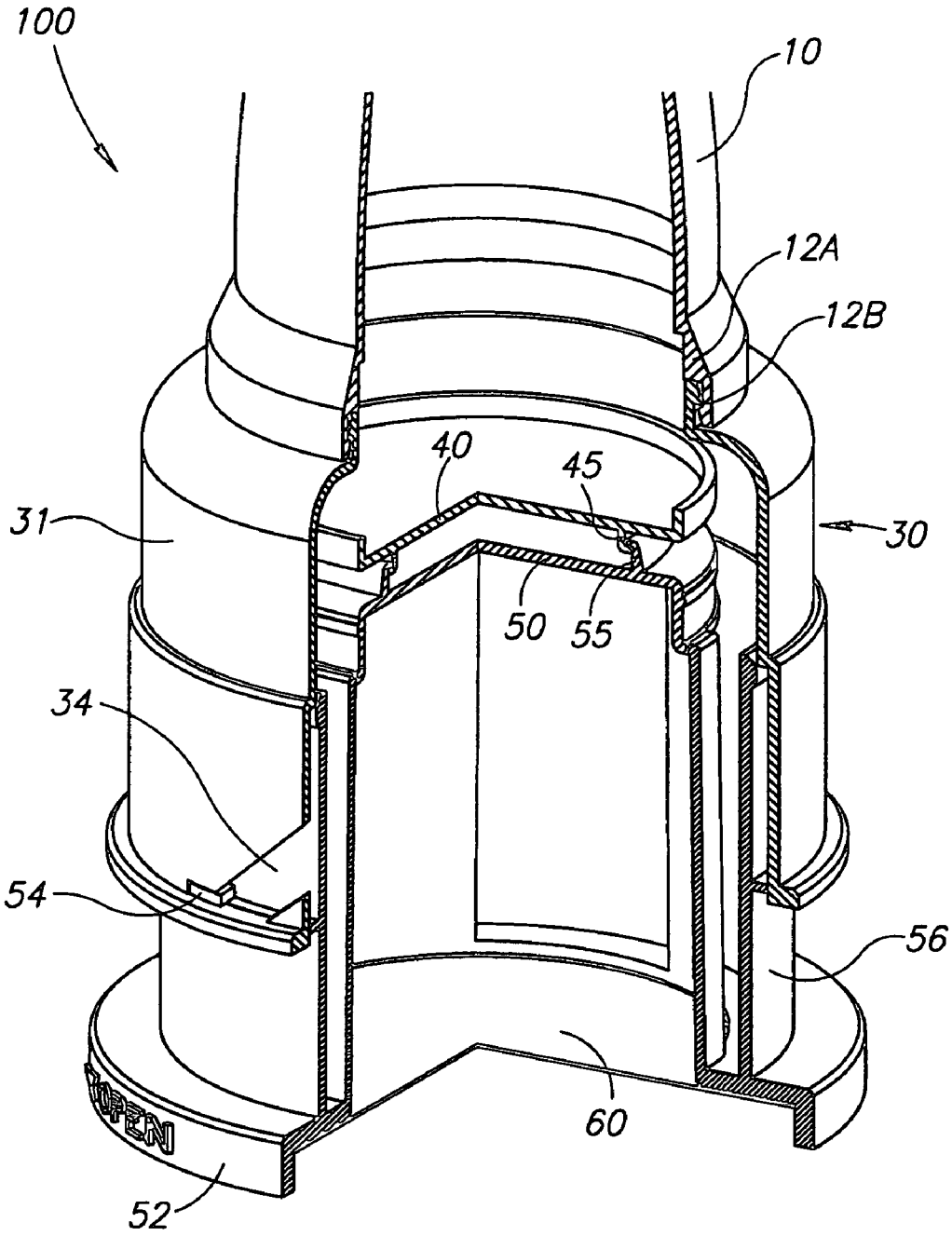
FIG. 6 is a detailed partial cutaway view of the two-compartment container assembly of FIG. 1 with the displaceable member in its unsealed position.

FIG. 6 illustrates a detailed cutaway view of a fully assembled two-compartment container 100 whose assembly units have been unsealed so that the two compartments are in communication with each other. The displaceable member 56 has been axially displaced to its unsealed position and hence the guide pin 54 is in its lower-most position in the guide slot 34. The bottom sealing member 40 remains coupled to the top sealing wall 50 of the cartridge unit 30 by the interlocked coupling arms 45 and 55. The bottom sealing member 40 has been pulled down by the downward axial displacement of the displaceable member 56 disengaging from the upper flange portion 12A.

Once the two-compartment container 100 is properly assembled and the coupling arms 45 and 55 are interlocked, and a user turns the manipulable portion 52 of the cartridge unit 30 and moves the displaceable member 56 to the unsealed position, both the top sealing wall 50 of the cartridge unit 30 and the bottom sealing member 40 of the dispensing unit 10 will be unsealed and the internal spaces of the dispensing unit 10 and the cartridge unit 30 will be in flow-communication. Of course the strength of the coupling provided by interlocking of the coupling arms 45 and 55 should be sufficiently strong to be able to pull and unseal the bottom sealing member 40.

The interlocking of the top sealing wall 50 and the bottom sealing member 40 of the assembly units 30 and 10, respectfully, allows the user to store each component of a formulation in sealed assembly units and assemble them into a container while keeping the assembly units intact as sealed units in order to prepare the formulation. Because the assembly units can remain intact as sealed units while assembling them into a container, the risk of contaminating the stored contents of the assembly units is minimized.

In another embodiment of the container assembly 100, once the assembly units 10 and 30 are brought together, the dispensing unit 10 and the cartridge unit 30 may be twisted or rotated about their longitudinal axis in opposite directions so that the coupling arms 45 and 55 align with each other and interlock their locking ridges 47 and 57.

In another embodiment of the container assembly 100, each of the sealing mechanisms (sealing member 40 and top sealing wall 50) may be provided with a single coupling arm on each of the sealing mechanisms. For example, each sealing mechanisms may be provided with a coupling arm that extends in a half circle.

Figure 6A:
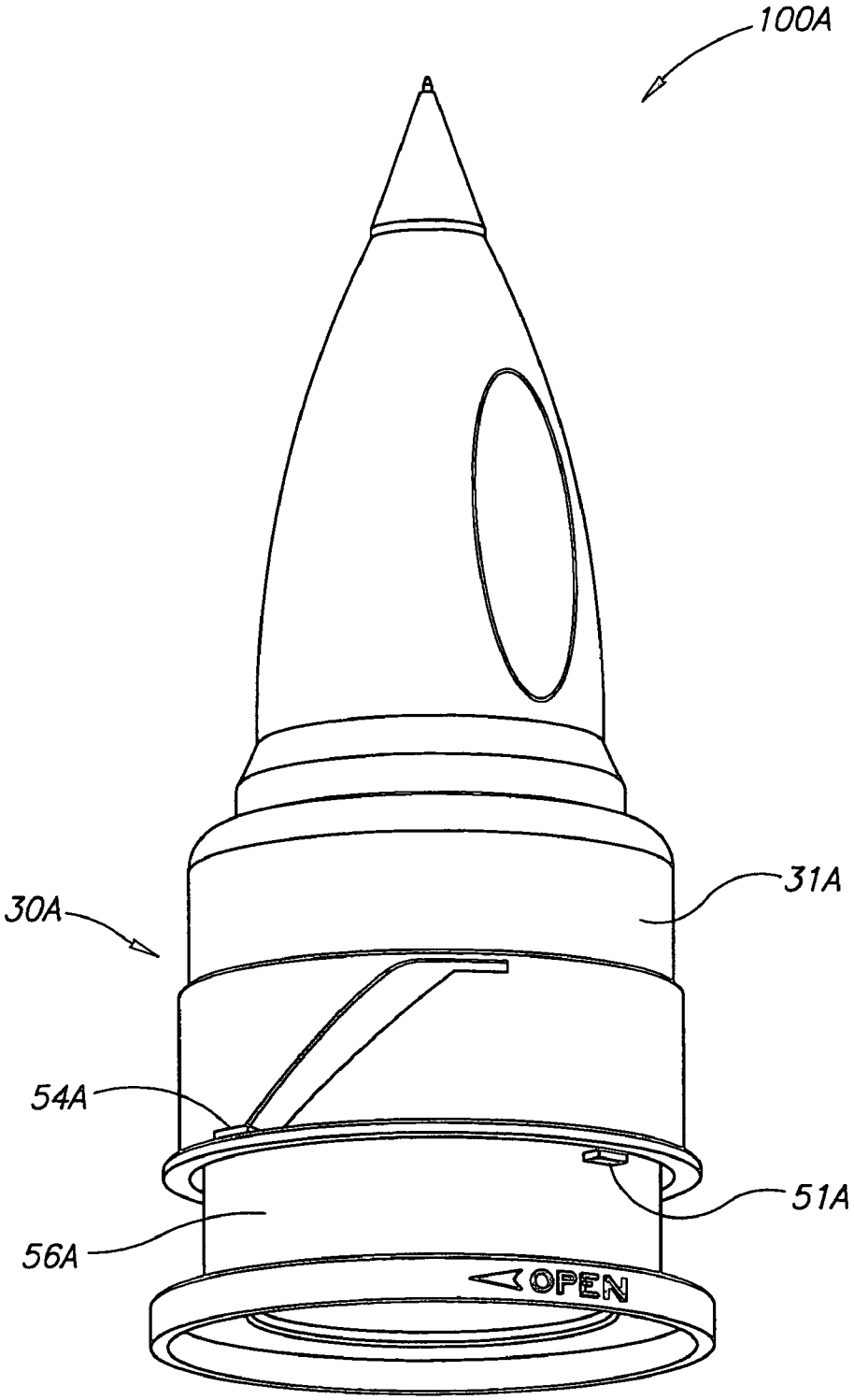
FIG. 6A is a perspective view of another embodiment of the two-compartment container assembly of FIG. 1.

FIG. 6A illustrates yet another embodiment of the container assembly 100A. In this embodiment, a displaceable member 56A may be configured and adapted to prevent that member from being returned to its sealed position once it has been axially displaced to its unsealed position. For example, in addition to guide pins 54A, the displaceable member 56A may be provided with a second set of pins 51A that is positioned closer to the bottom end of the displaceable member 56A so that when the displaceable member 56A is axially displaced to its unsealed position, the pins 51A protrudes out below the cartridge housing 31A. The pins 51A are sufficiently tall to interfere with the cartridge housing 31A to prevent the displaceable member 56A from returning to its sealed position. In this embodiment, the cartridge housing 31A and the displaceable member 56A are made from materials sufficiently elastic to accommodate the displaceable member 56A, with the pins 51A protruding from its outer surface, within the cartridge housing 31A. When the cartridge unit 30A of this embodiment is initially assembled, the pins 51A are Such feature would prevent an undesired reuse of the container after its content has been dispensed.

It would be obvious to one of ordinary skill in the art that the closure member 60 that seals the bottom opening 38 of the cartridge unit 30 may be configured and adapted to take on a form similar to the bottom sealing member 40 of the dispensing unit 10. For example, the closure member 60 may also be configured to have structures similar to the coupling arms 45 so that a second cartridge unit (not shown) may be engaged to the bottom end of the cartridge unit 30 adding a third compartment to the container assembly 100.

Similarly, any number of cartridge units may be assembled serially in this manner to form a multi-compartment container assembly having any desired number of compartments. Furthermore, a multi-compartment container assembly may be assembled by connecting two or more cartridge units in series without any dispensing unit. Once the contents of the cartridges are mixed, whether they be liquids, powders, or combinations, the contents may be directly dispensed through the end opening of one of the two terminally located cartridges. In other words, the mixed content may be dispensed through the top opening of the top cartridge or the bottom opening of the bottom cartridge. If a separate dispensing device were required by a particular application, an appropriate dispensing device may be attached to the opening of the dispensing unit.

It would be appreciated by one of ordinary skill in the art that another configuration of a multi-compartment container assembly may include one or more of the cartridge units as described herein attached to both open ends of a dispensing unit. In another embodiment, the dispensing unit may be a bottle like container having only one opening. Again, one or more cartridge units may be attached in series to such a dispensing unit to assemble a multi-compartment container assembly.

Furthermore, according to one embodiment of the present invention, two or more cartridge units may be assembled serially to assemble a multi-compartment container. Each of the cartridge units in the assembly constitutes a sealed compartment holding a component of a formulation to be mixed. Once the contents of the container assembly have been mixed and are ready to be dispensed, the displaceable member of the upper-most cartridge unit in this assembly is moved to its unsealed position so that the mixed formulation can be dispensed through the top opening of the upper-most cartridge unit. If necessary, an appropriate dispensing device, such as a baby feeding nipple, can be attached to the top opening of the upper-most cartridge unit.

Figure 7:
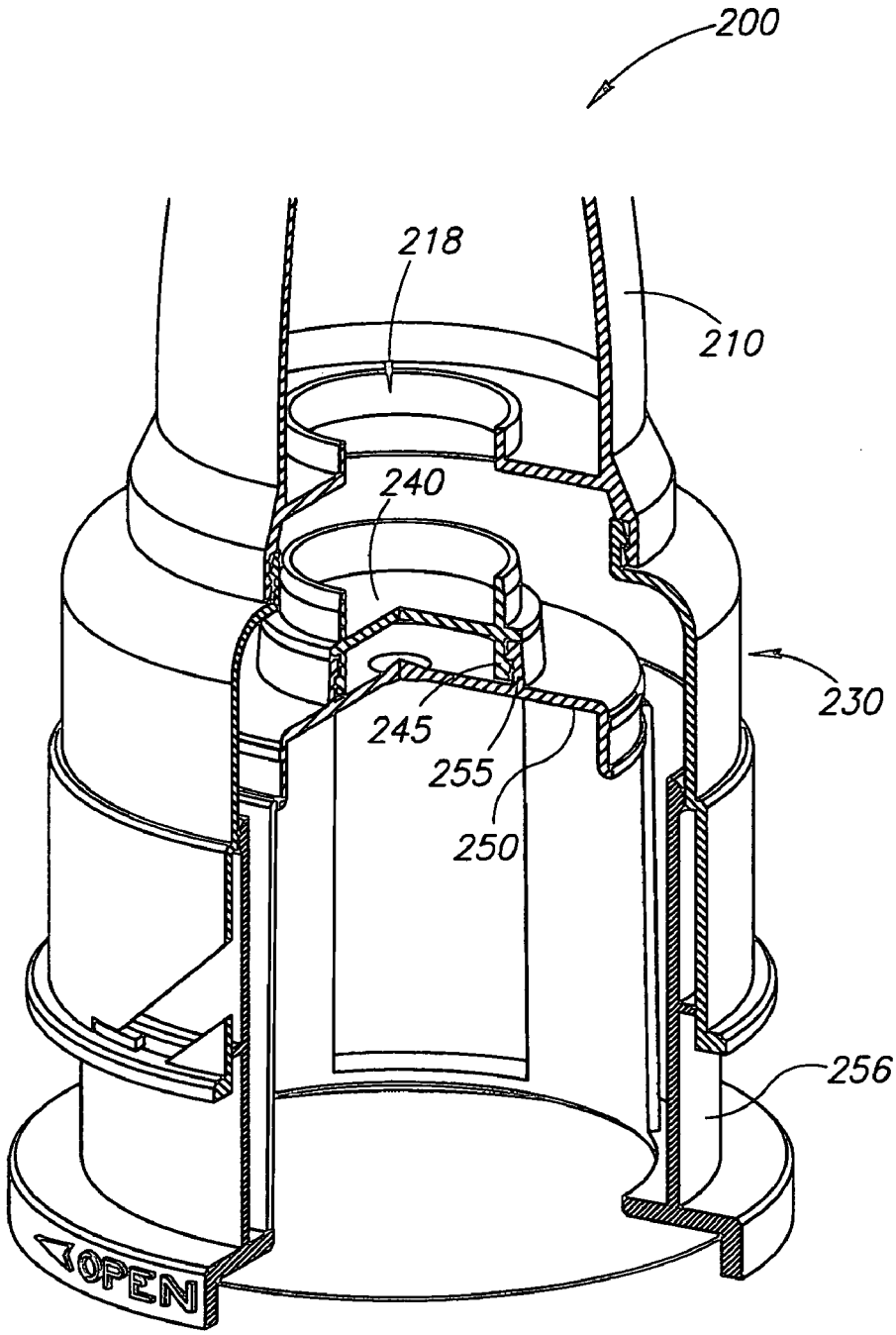
FIG. 7 is a detailed partial cutaway view of another embodiment of the coupling mechanism for the sealing member of the dispensing unit and the top seal wall of the cartridge unit.

FIG. 7 illustrates a two-compartment container assembly 200 according to another embodiment of the present invention where the container is assembled with a dispensing unit 210 and a cartridge unit 230. The bottom opening 218 of the dispensing unit 210 has a smaller diameter than in the previously described embodiments. The smaller diameter of the bottom opening 218 may be more suitable for an application requiring filling the dispensing unit 210 with a pressurized component. By reducing the size of the bottom opening, the sealing member 240 is accordingly smaller and thus the pressure exerted on the sealing member 240 by the internal pressure can be reduced. This minimizes the chance that the sealing member 240 might be pushed out of its sealed position before being assembled with a cartridge unit. The smaller diameter sealing member 240 has a plurality of J-shaped coupling arms 245 on the side facing the cartridge unit 230. The displaceable unit 256 is provided with top sealing wall 250 that sealingly engages with rim 232 when the displaceable member 256 is in its sealed position. A plurality of J-shaped coupling arms 255 is provide on the top surface of the top sealing wall 250 for coupling with the sealing member 240 by interlocking with the coupling arms 245. In this embodiment, the coupling arms 245 and 255 are provided as a plurality of arms, similar to the coupling arms 45 and 55 in the container 100, but the coupling arms 245 and 255 are arranged in a circular formation with minimal spaces between each of the plurality of coupling arms. The actual number of arms provided for each group 245 and 255 may vary depending upon the particular application and would be a matter of design choice. These coupling arms 245 interlock with the coupling arms 255 by snap-fitting with when the dispensing unit 210 and the cartridge unit 230 are brought together for assembly. The coupling arms 245 and 255 are both arranged in a circular configuration with coupling arms 245 in a smaller diameter configuration. And the coupling arms 245 and 255 are oriented so that the hook-end of the J-shaped profile of the coupling arms 245 are facing the hook-end of the J-shaped profile of the coupling arms 255. When the dispensing unit 210 and the cartridge unit 230 are brought together, the coupling arms 245 and 255 elastically bend to allow the coupling arms 245 to slide inside the circle formed by the coupling arms 255 until they interlock. In this embodiment, the rotational movement of the displaceable member 256 is not required to interlock the coupling arms 245 and 255.

It would be obvious to one of ordinary skill in the art to provide the coupling arms 245 and 255 in other appropriate configurations. For example, the coupling arms 245 and 255 each may be solid circular structures.

Figure 8:
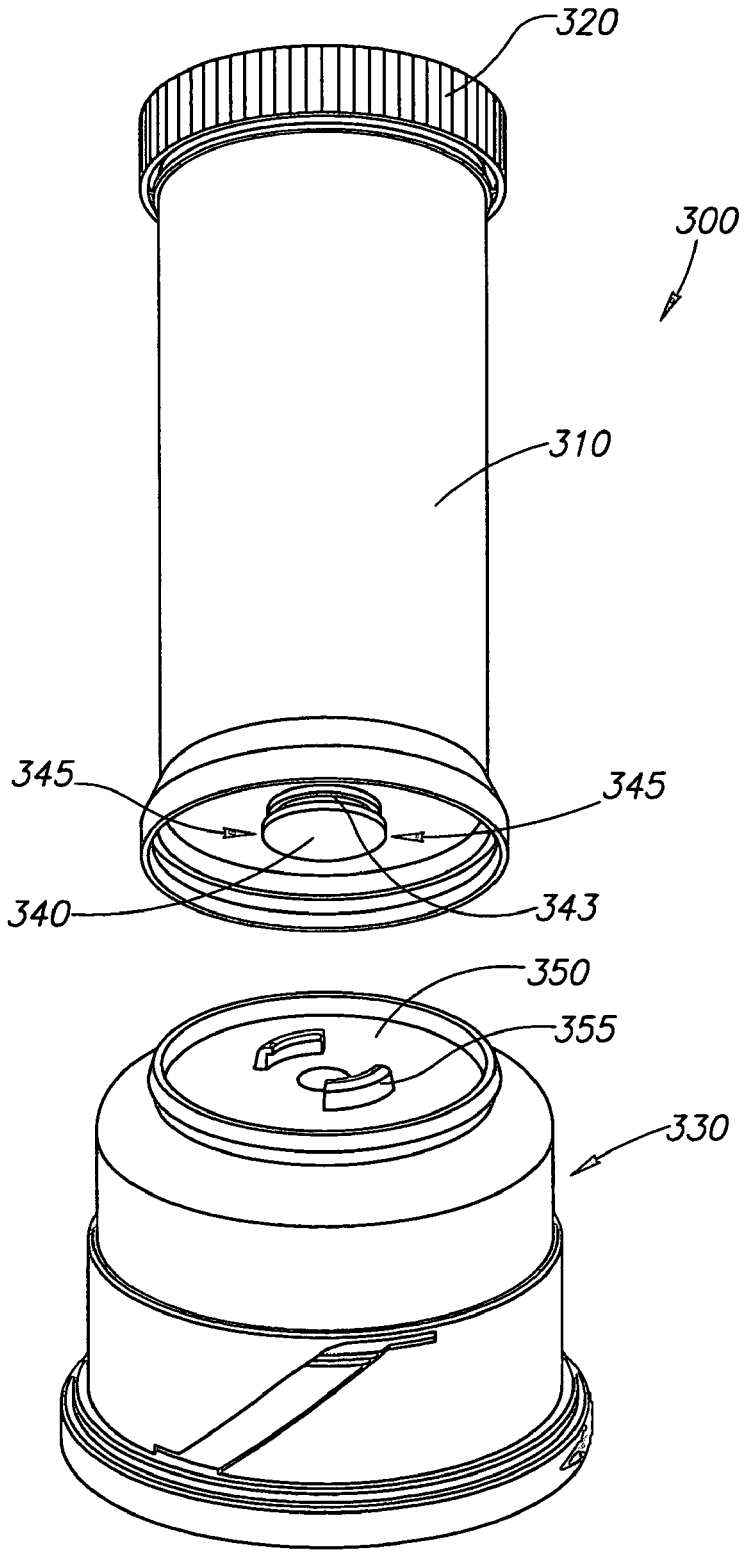
FIG. 8 is a perspective view of a dispensing unit and a cartridge unit illustrating another embodiment of the coupling mechanism for the sealing member of the dispensing unit and the top seal wall of the cartridge unit.

FIG. 8 illustrates another embodiment of a two-compartment container assembly 300 where the coupling mechanism between the dispensing unit's bottom sealing member and the top sealing wall of the cartridge unit is provided in a different configuration. In this embodiment, the bottom sealing member 340 of the dispensing unit 310 has an extension 343 that protrudes downwardly and has an elliptically shaped bottom end having two ends 345 that extend beyond the extension 343. The top sealing wall 350 of the cartridge unit 330 has two coupling arms 355 that have a J-shaped profile. The coupling arms 355 are located equidistant from the center of the top sealing wall 350 with the hook-end of the J-shaped coupling arms 355 facing each other. The top opening of the dispensing unit 310 is sealed with a screw cap 320.

Figure 9:
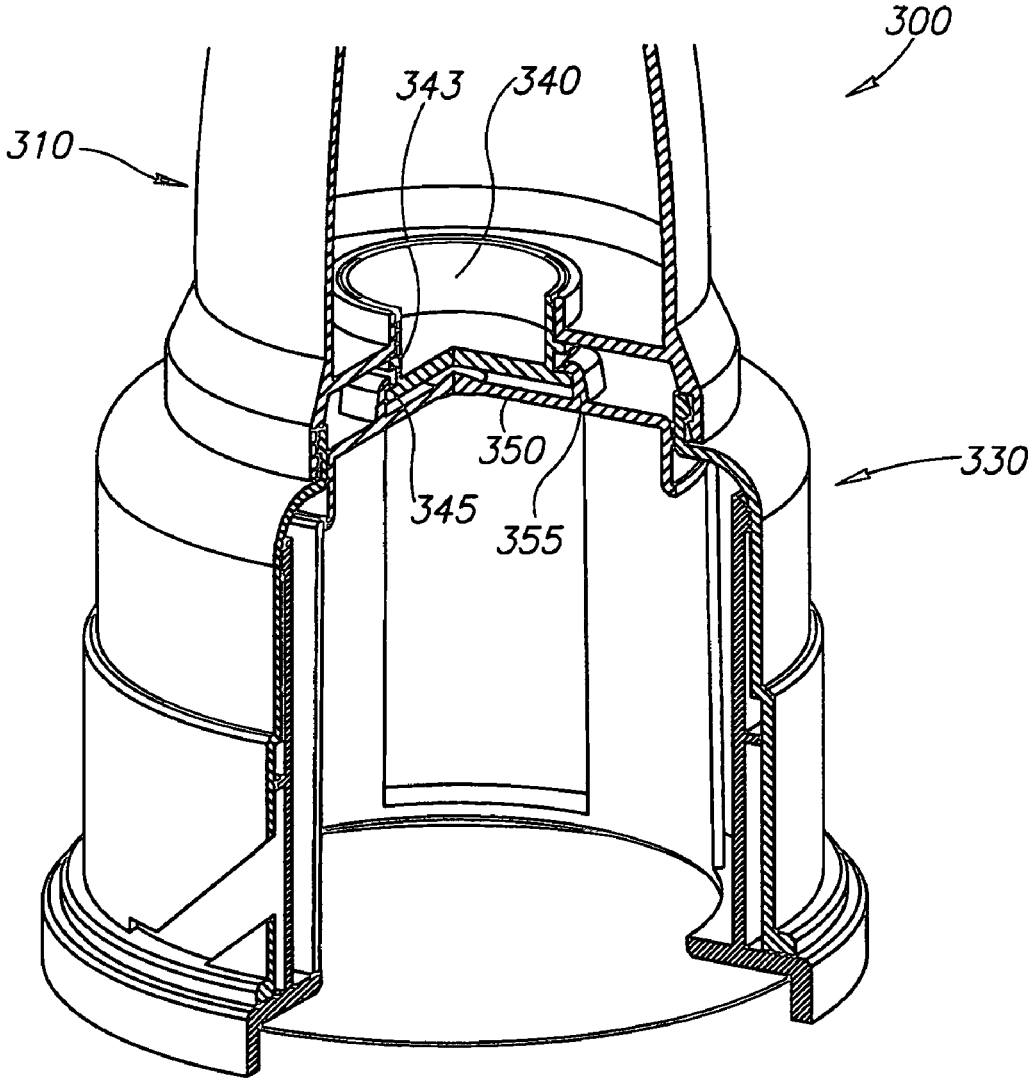
FIG. 9 is a detailed cutaway view of a two-compartment container assembled with the assembly units of FIG. 8 where the displaceable unit is in its sealed position.

FIG. 9 is a partial cutaway illustration of the fully assembled container assembly 300 and the configuration described above can be seen in more detail. The bottom opening of the dispensing unit 310 is sealed with a sealing member 340. In this view, the dispensing unit 310 and the cartridge unit 330 have been assembled together but the sealing member 340 and the top sealing wall 350 have not yet been coupled together. As illustrated, the dispensing unit 310 and the cartridge unit 330 are oriented so that the extending ends 345 of the elliptical bottom end of the sealing member 340 lie between the two coupling arms 355. To couple the sealing member 340 and the top sealing wall 350, the user would twist the dispensing unit 310 and the cartridge unit 330 in opposite directions about the longitudinal axis of the assembly, thereby causing the extending ends 345 of the elliptical bottom end of the sealing member 340 to slide under the hook end of the J-shaped coupling arms 355.

Figure 10:
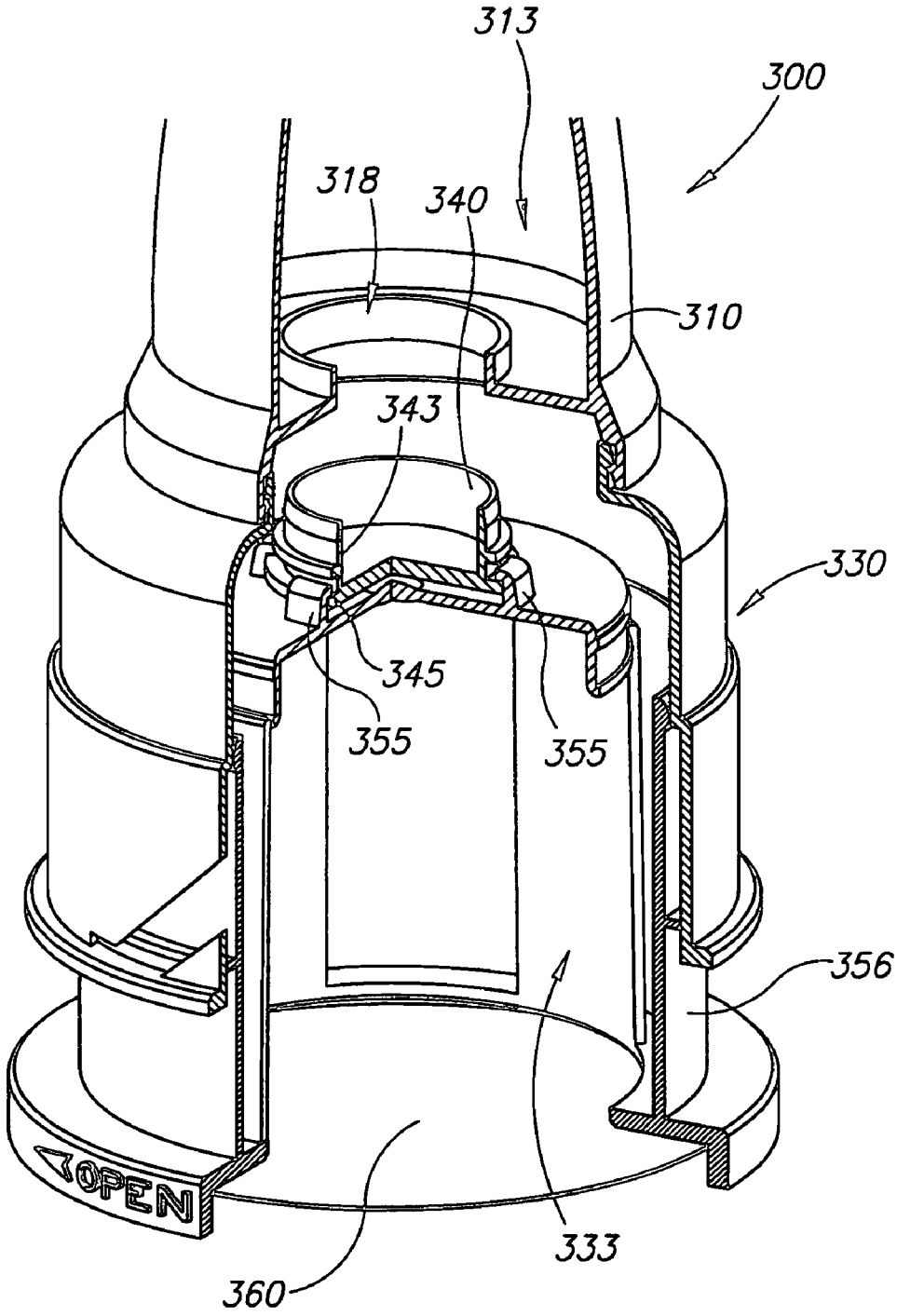
FIG. 10 is a detailed cutaway view of a two-compartment container assembled with the assembly units of FIG. 8 where the displaceable unit is in its unsealed position.

FIG. 10 illustrates the two-compartment container assembly 300 after the displaceable member 356 has been axially displaced to its unsealed position unsealing the coupled sealing member 340 and the top sealing wall 350. The top compartment 313 (defined by the internal space of the dispensing unit 310) and the bottom compartment 333 (defined by the internal space of the displaceable member 356) of the container assembly 300 are now in flow communication through the bottom opening 318 of the dispensing unit 310. has been pulled out of is sealing position leaving the bottom opening 318 of the dispensing unit 310 open. The bottom opening of the cartridge unit 330 is illustrated as being sealed with a closure member 360. As discussed previously in conjunction with the container assembly 100, in another embodiment of the invention, the bottom end of the displaceable member 356 of the cartridge unit 330 may be configured and adapted to have a structure similar to that of the bottom end of the dispensing unit 310. Thus, a second cartridge unit may be engaged to the bottom end of the cartridge unit 330 to form a third compartment of the container assembly 300.

It will be appreciated that the above descriptions are intended only to serve as examples, and that many other embodiments are possible and encompassed within the spirit and the scope of the present invention. The assembly units, cartridge units and the dispensing units, described herein and illustrated in the figures are examples only. Assembly units embodying other variations of the structures described here are within the scope of the present invention. For example, a multi-compartment container system according to the present invention may be configured so that the dispensing unit is configured and adapted to hold a predetermined amount of substance. Such container may be used to store a bulk volume of a substance in the other compartments and use the dispensing unit to measure a predetermined single dose of the substance for dispensing. The bottom sealing member of the dispensing unit may be opened by axially displacing the displaceable member of the cartridge unit that is attached to the dispensing unit and let the contents of the cartridge unit fill the dispensing unit. Next, the sealing member of the dispensing unit is resealed by axially displacing the displaceable member to its sealed position. The dispensing unit now is filled with a predetermined amount of the substance that may be dispensed through a separate dispensing opening on the top end of the dispensing unit.

We claim:

1. A multi-compartment container system comprising:

at least two assembly units;

at least one of the assembly units being a cartridge unit, the cartridge unit comprising:

a cartridge housing having an opening at each of its top and bottom ends;

at least one of the two openings adapted and configured to engage and seal the other of said at least two assembly units;

a displaceable member having a sealing wall at one end, a manipulable portion at the other end adapted and configured to be controlled by a user to move the displaceable member, and at least one connecting member extending between the sealing wall and the manipulable portion;

a closure member sealing the other of the two openings;

wherein the displaceable member is moveable between a sealed position, where the sealing wall engages the cartridge housing sealing the top end opening of the cartridge housing, and an unsealed position, where the sealing wall is disengaged from the cartridge housing and the top end opening is open; and the other of the at least two assembly units having at least one opening sealed with a sealing member, said at least one opening adapted and configured to engage the top end opening of the cartridge housing, said sealing wall and said sealing member each provided with at least one coupling arm that interlock with one another when the two assembly units are assembled, wherein when the displaceable member is moved to its unsealed position disengaging the sealing wall from the cartridge housing, the sealing member is also disengaged from the at least one opening of the other of the at least two assembly units.

2. A multi-compartment container system according to claim 1, wherein the coupling arms provided on the sealing wall and the sealing member are protrusions having locking ridges.

3. A multi-compartment container system according to claim 1, wherein the coupling arms provided on the sealing wall and the sealing member are protrusions having a J-shaped profile.

4. A multi-compartment container system according to claim 1, wherein the coupling arms provided on the sealing wall and the sealing member are a plurality of radially positioned protrusions having locking ridges.

5. A multi-compartment container system according to claim 1, wherein the coupling arms provided on the sealing wall and the sealing member are a plurality of radially positioned protrusions having a J-shaped profile.

6. A multi-compartment container system according to claim 1, wherein the at least one of the top and bottom openings of the cartridge housing is provided with screw threads for sealingly engaging another assembly unit.

* * * * *